US007857001B2

(12) United States Patent
Kristensen et al.

(10) Patent No.: US 7,857,001 B2
(45) Date of Patent: Dec. 28, 2010

(54) SYSTEM AND METHOD TO TRANSFER FLUID

(75) Inventors: Per Herbert Kristensen, Rykkinn (NO); Bjørn R. Lien, Oslo (NO); Per Erik Christiansen, Moss (NO); Leif Harald Pettersen, Rolvsay (NO); Alexander Areshev, Rykkinn (NO)

(73) Assignee: Moss Maratime AC, Lysaker (NO)

( * ) Notice: Subject to any disclaimer, the term of this patent is extended or adjusted under 35 U.S.C. 154(b) by 307 days.

(21) Appl. No.: 10/538,250

(22) PCT Filed: Dec. 10, 2003

(86) PCT No.: PCT/NO03/00414

§ 371 (c)(1),
(2), (4) Date: Aug. 23, 2005

(87) PCT Pub. No.: WO2004/053384

PCT Pub. Date: Jun. 24, 2004

(65) Prior Publication Data

US 2006/0118180 A1 Jun. 8, 2006

(30) Foreign Application Priority Data

Dec. 10, 2002 (NO) ..... 20025926

(51) Int. Cl.
*F15B 13/00* (2006.01)

(52) U.S. Cl. ..... 137/615; 141/279

(58) Field of Classification Search ..... 137/615; 141/279, 284, 387, 388; 138/107, 119, 177, 138/178, DIG. 11; 428/592
See application file for complete search history.

(56) References Cited

U.S. PATENT DOCUMENTS 1,478,925 A * 12/1923 Steed ..... 137/615
1,680,831 A * 8/1928 White ..... 137/615

(Continued)

FOREIGN PATENT DOCUMENTS

EP 1389580 2/2004

(Continued)

OTHER PUBLICATIONS

Tulsa Tube Bending Website, 2000-2004, p. 1, "Helical and spiral coil bending up to 8 inch IPS . . . ".*

*Primary Examiner*—John Rivell
*Assistant Examiner*—Craig Price
(74) *Attorney, Agent, or Firm*—Christian D. Abel

(57) ABSTRACT

The invention relates to a system to transfer fluid via at least one pipeline from one structure to another structure (such as a platform P and a vessel v respectively), in which one of the structures has an offloading arm 5 which is movable in to planes perpendicular to each other and in which a part of the offloading arm remote from the one structure is engagable with the other structure, so to allow linear and rotational movements between the structures. The pipeline along the offloading arm is configured to compensate for movements between the two structures in the longitudinal direction of the offloading arm.

3 Claims, 7 Drawing Sheets

U.S. PATENT DOCUMENTS

| | | | | | |
|---|---|---|---|---|---|
| 2,720,217 | A | * | 10/1955 | Vossbrinck | 137/561 R |
| 3,032,082 | A | | 5/1962 | Vilian | |
| 3,176,730 | A | * | 4/1965 | Knight | 141/290 |
| 3,199,553 | A | * | 8/1965 | Garrett et al. | 141/388 |
| 3,249,121 | A | * | 5/1966 | Bily | 137/615 |
| RE26,351 | E | * | 2/1968 | Sheiry | 137/615 |
| 3,381,711 | A | * | 5/1968 | Fye et al. | 137/615 |
| 3,487,858 | A | * | 1/1970 | Hanback | 138/178 |
| 3,632,140 | A | * | 1/1972 | Paine et al. | 138/178 |
| 3,721,260 | A | | 3/1973 | Stahmer | |
| 3,746,060 | A | * | 7/1973 | Janssen et al. | 141/387 |
| 4,121,616 | A | * | 10/1978 | Lochte et al. | 137/615 |
| 4,206,782 | A | * | 6/1980 | Tuson | 137/615 |
| 4,315,533 | A | | 2/1982 | Eagles | |
| 4,376,452 | A | | 3/1983 | Tax | |
| 4,388,948 | A | * | 6/1983 | Carminati et al. | 137/615 |
| 4,391,297 | A | * | 7/1983 | Knight | 137/615 |
| 4,393,906 | A | | 7/1983 | Gill | |
| 4,671,704 | A | | 6/1987 | Vidal | |
| 4,735,167 | A | | 4/1988 | White | |
| 4,867,211 | A | * | 9/1989 | Dodge et al. | 141/279 |
| 6,343,620 | B1 | * | 2/2002 | LeDevehat et al. | 137/615 |

FOREIGN PATENT DOCUMENTS

| | | |
|---|---|---|
| GB | 2029794 | 3/1980 |
| NO | 155765 | 1/1980 |

* cited by examiner

SYSTEM AND METHOD TO TRANSFER FLUID

TECHNICAL FIELD OF THE INVENTION

The invention relates to a system to transfer fluid such as cryogenic fluids for instance natural gas in liquefied or condensate form from one structure to another, hereafter referred to as a platform and a vessel respectively and vice versa, where the system includes an offloading arm connecting the platform and the vessel and carrying at least one pipeline.

BACKGROUND OF THE INVENTION

It is known that some systems for the same purpose have been designed. The known systems include a Statoil system based on multi flexible pipes, a FMC system based on series of chiksan swivel joints, Bluewater underwater offloading system, Kvaerner Moss offloading arm based on double-arm construction, and Conoco HiLoad system based on pipe bridge and others.

In particular, it is known from OTC Paper 14096 (presented at Houston, Tex. in May 2002) that rigid articulated loading arms may be connected between an FPSO and a shuttle tanker. The rigid loading arms are hingedly connected together, and contain thermal insulation for hingedly connected pipelines within those loading arms. The arrangement has to allow for continual rotational motion of significant amplitude between the hinged joints connecting the rigid articulated loading arms.

Other examples on transferral of fluids at sea are described in U.S. Pat. No. 4,671,704 and GB 2029794.

The aim of the present invention is to provide a system for transfer of fluid between two structures offshore, which is flexible, reliable in harsh weather conditions and economically feasible.

The aim of the invention is obtained by a system and method according to the following claims.

DISCLOSURE OF THE INVENTION

The invention relates to a system to transfer fluid via at least one pipeline from one structure to another structure. The structures may be floating or fixed relative to the ground, such as platforms, floating platforms, vessels, barges etc. The combination may be a combination of any of these. One of the structures has an offloading arm which is movable in two planes perpendicular to each other, so that it is movable in three directions. A part of the offloading arm remote from the one structure is engagable with the other structure, so to allow linear and rotational movements between the structures. The pipeline for the transfer of fluid runs along the offloading arm and is configured to compensate for movements between the two structures in the longitudinal direction of the offloading arm. The fluid may for instance be cryogenic fluid, such as liquefied or condensate natural gas.

At least one part of the pipeline along the offloading arm is attached to the offloading arm by means of at least one support moveable lengthwise relative to the offloading arm. This part of the pipeline includes at least one pipeline section, a first pipeline section, configured to compensate for movements in the longitudinal direction of the offloading arm. Other parts may be straight rigid pipe parts. The length of the first section, is determined by the type of compensation necessary for the different uses, in relation to economics and type of configuration used.

One embodiment comprises the first pipeline section configured with V-shaped rigid pipelines with swivel joints. These pipe lines are especially adapted for fluids at low temperatures. The V-shaped rigid pipelines with swivel joints may be inverted and running in a generally vertical plane, generally parallel to the offloading arm. Other configurations are also possible, like for instance V-shaped in a generally horizontal plane, or double V-shaped etc.

In another embodiment the first pipeline section may be configured as a spiral with the axis of the spiral extending mainly parallel with the longitudinal direction of the offloading arm, and where the spiral pipeline is capable of sustaining a spiral shape under the combined weight of the pipeline and fluid within the pipeline. A combination of these embodiments would also be possible.

Normally the part of the pipeline which is connected to the offloading arm to allow movements lengthwise of the offloading arm, will also include at least a second rigid pipeline section. This second rigid pipeline section is connected to supports moveable lengthwise relative to the offloading arm. Rigid pipeline sections may be on both sides of the first pipeline section.

The supports with which the part of the pipeline is movable along the offloading arm may be of many kinds. One is a wheel mounted trolley, others are blocks running on rails or blocks with brush-connection or running grooves.

The part of the pipeline remote from the one structure and engagable with the other structure is itself connected to or part of another support moveable lengthwise relative to the offloading arm. The connection between the offloading arm and the other of the structures may be formed as a pin downwardly dependant from the offloading arm, and rotatable about a vertical axis in a receptacle on the other of the structure. Tension may be applied between the other structure and the part of the offloading arm engagable with that other structure, so to resist separation of the loading arm and the other structure.

The pipeline is connected to the respective structures by joints capable of accommodating angular and rotational movement between the pipeline and the respective structure. In one embodiment the pipeline is connected to one of the respective structures by a hinge joint and to the other of the respective structures by a universal joint. Normally the pipeline also has at least one joint arranged to compensate for thermal expansion and contraction relative to the offloading arm and/or either or both of the structures, whereby to allow optimum alignment of adjacent lengths of pipeline.

On the offloading arm there may be a plurality of pipelines extending between the structures.

The invention also includes a method of transferring fluid from one structure to another structure, in which one of the structures has an offloading arm which is movable in a vertical plane about a horizontal axis and which is also rotatable about a vertical axis, and which comprises the steps of arranging a part of the offloading arm to engage with the other structure, so to allow linear and rotational movement between the structures The invented system is preferably a stern to bow (tandem) type offloading system. Based on the specific characteristics of the first pipeline section that in this case compensate relative distance and relative heeling of the platform and the vessel avoiding transfer of any loads or/and bending moments to the connecting pipelines. The main components of the system ensure safe and efficient offloading of cryogenic fluid even in harsh offshore environment. The offloading arm is preferably installed on the platform's aft deck and the receiving terminal is installed on the vessel's forecastle deck, but one can consider other possibilities as for instance the opposite or sideways even if this is not preferred.

BRIEF DESCRIPTION OF THE DRAWINGS

Brief system description is presented on the following pages, with reference to the drawings where.

DESCRIPTION OF THE SPECIFIC EMBODIMENTS

Figure 1:
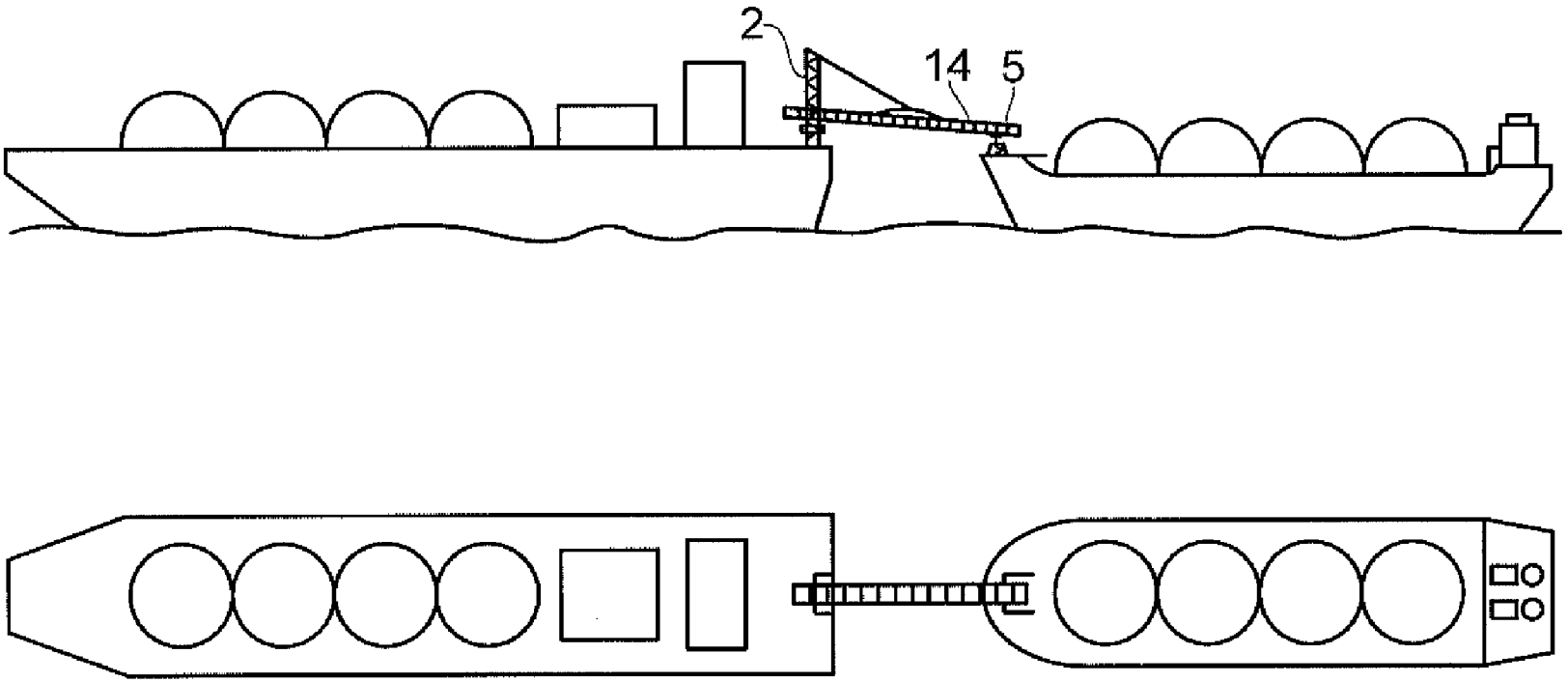
FIG. 1 shows one embodiment of the system according to the invention used in one instance between two vessels.
Figure 5:
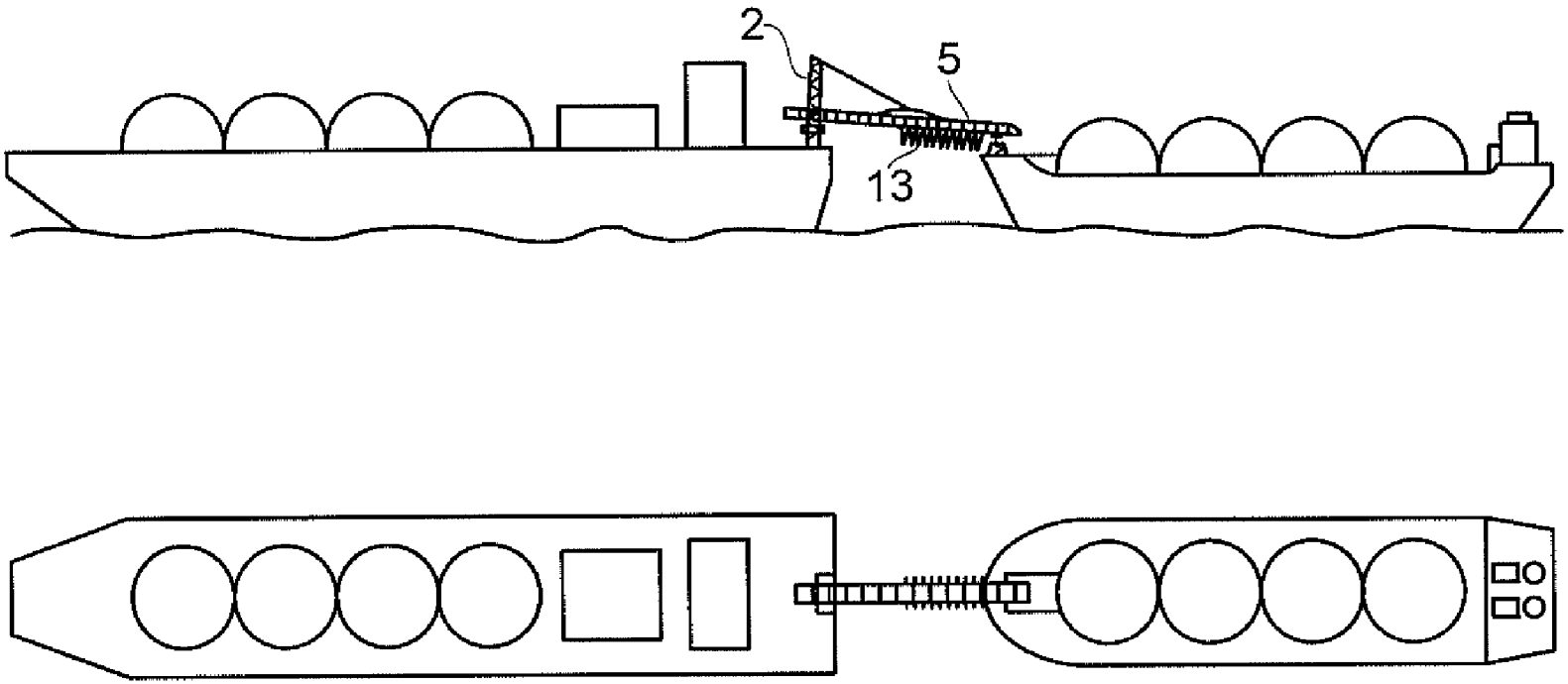
FIG. 5 shows a second embodiment of the system according to the invention used in one instance between two vessels.

The invention relates to a system to transfer fluid such as cryogenic fluids for instance natural gas in liquefied or condensate form from one to another structure, as shown conceptual in FIGS. 1 and 5.

Figure 2:
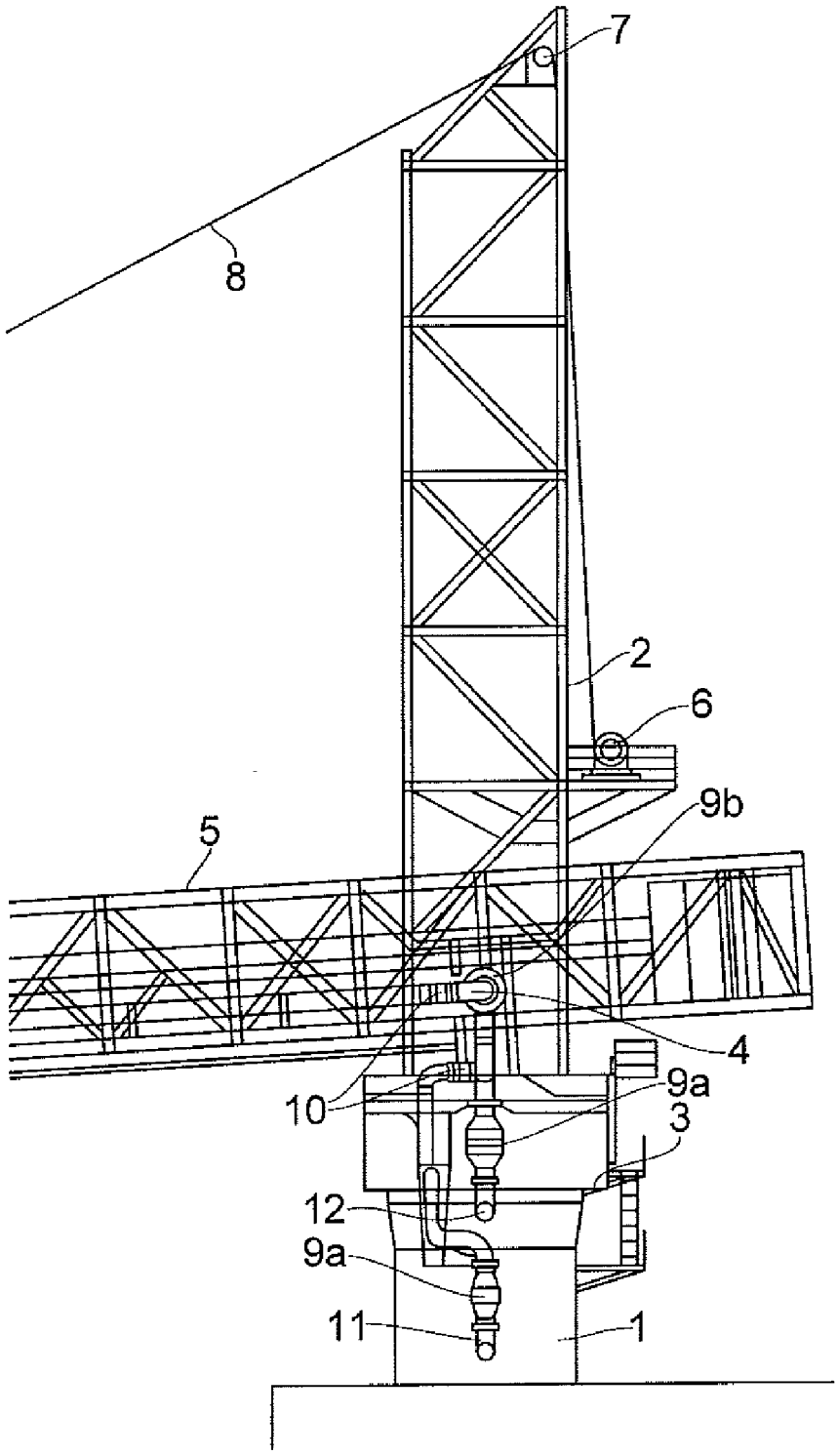
FIG. 2 shows side view of the crane, crane pedestal and crane column installed on the platform's deck.

As shown in FIG. 2, the invention comprises in both embodiments a crane pedestal 1 which is fastened to the aft deck of the platform. Crane column 2 is attached to the crane pedestal by slewing mechanism 3 comprising for example the roller bearings that provides rotating of crane column relative to the crane pedestal in vertical axis relative to the platform. Rotation is provided by means of at least one motor preferably hydraulic one (not shown). Hinge joints 4 ensure rotating of the crane boom 5, represented by a torsional flexible bridge that permits relative heeling between the platform and the vessel and carrying one or more cryogenic pipelines, relative to the crane column. Winch 6 or hydraulic cylinder (not shown) is installed on the crane column to operate crane boom relative to axis passing through hinge joints via at least one wire sheave 7 and at least one lifting wire 8 connected to the boom structure. The winch has a heave compensating system (not shown). Relative movement of the pipelines on the platform and on the boom is compensated by chiksan swivels 9. The swivels 9*a* rotate about the same axis as the crane pedestal and compensate relative movement of the system in horizontal plane. The swivels 9*b* rotate in the same axis as the hinge joints 4 and compensate relative movement of the system in vertical plane. Temperature expansion is taken care of by pipe compensators 10.

Figure 3:
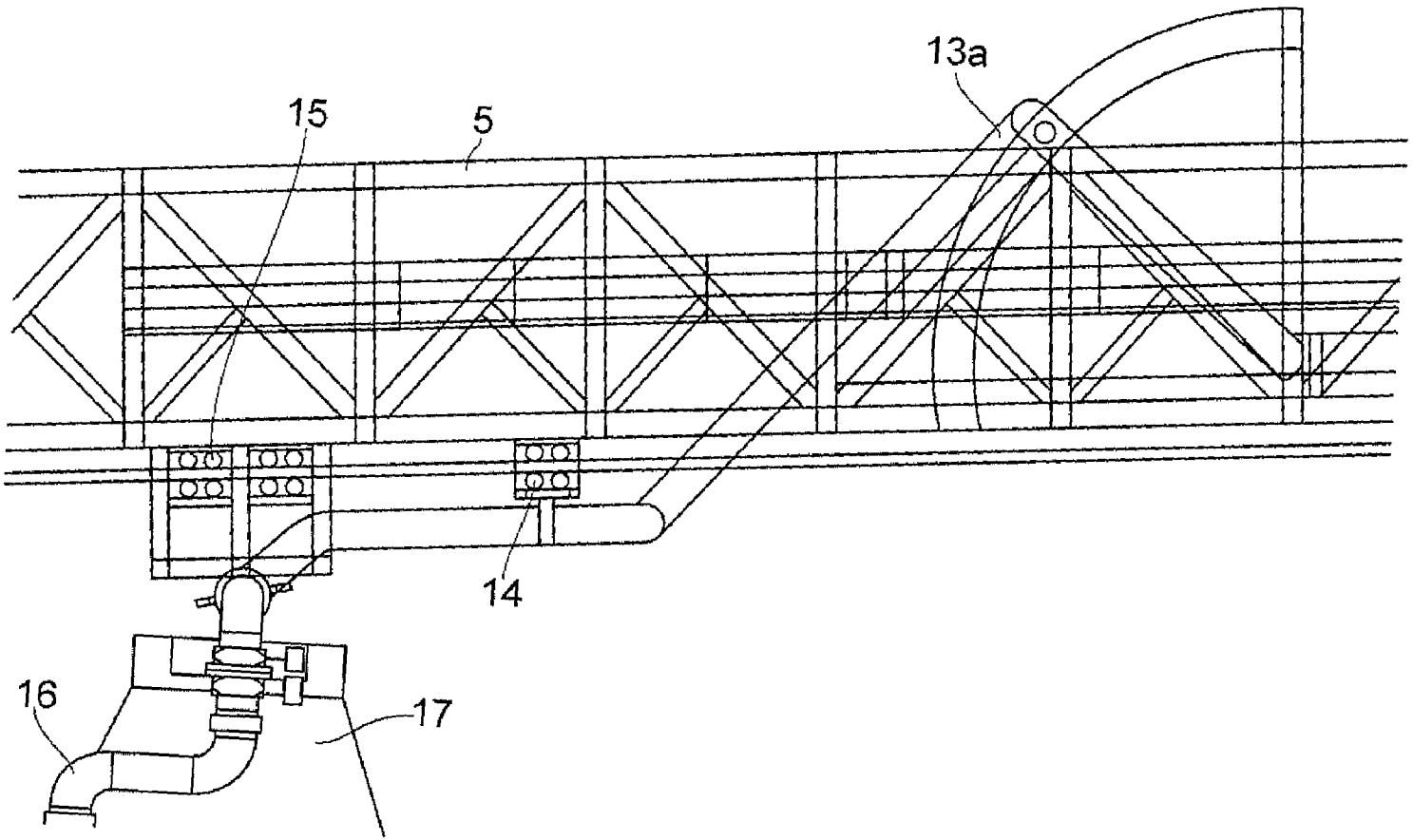
FIG. 3 shows side view of one embodiment of the bridge type offloading boom, receiving terminal and pipe connectors installed on the vessel's forecastle deck.
Figure 4:
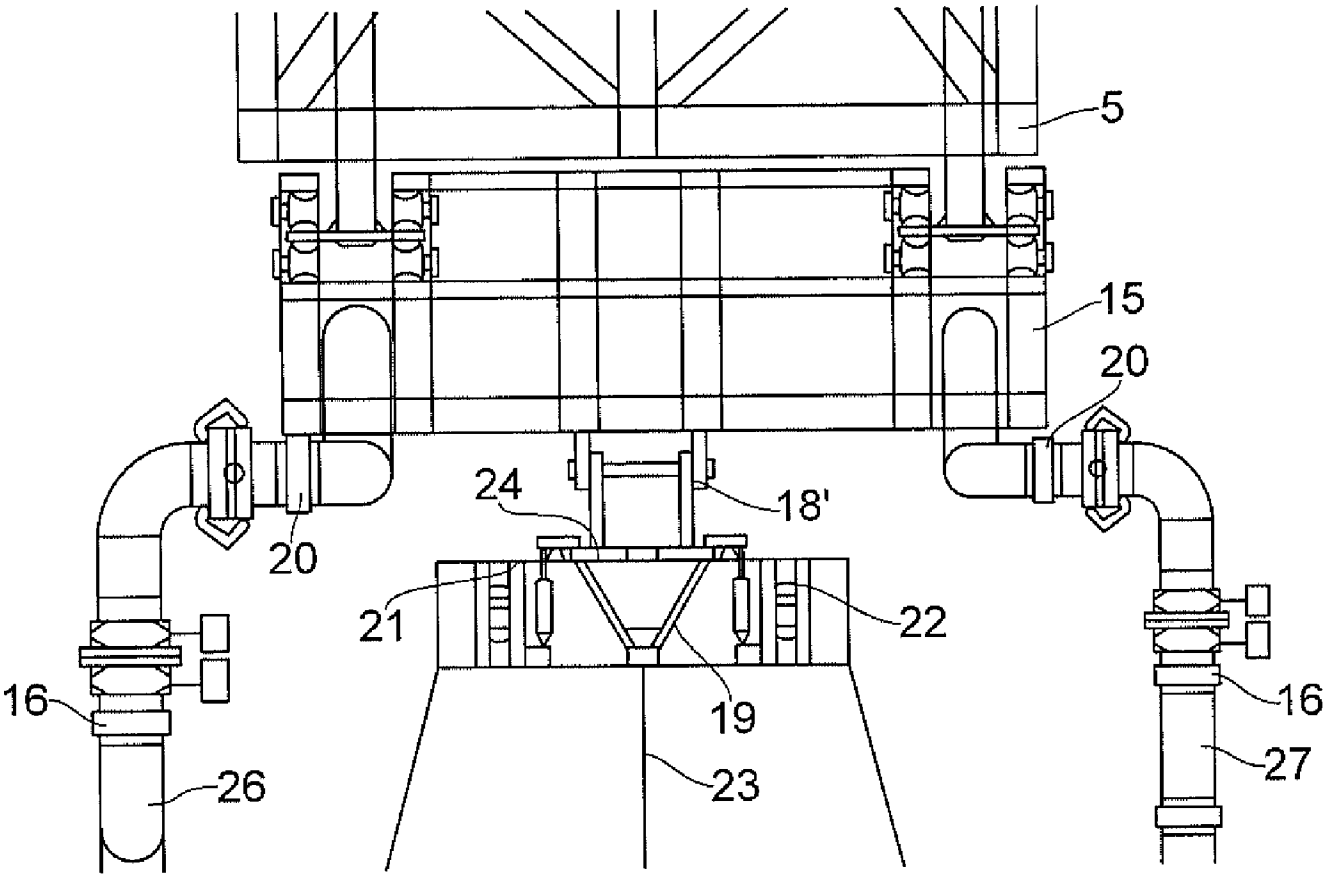
FIG. 4 shows one embodiment of the connection between connector trolley and receiving terminal installed on the vessel's forecastle deck.

In one embodiment of the invention as shown in FIG. 3-4, one end of the straight pipes on the boom 5 is connected to inverted V-shaped rigid pipelines with swivel joints 13*a* that compensate relative longitudinal motion between the platform and the vessel. The other end of the inverted V-shaped rigid pipelines with swivel joints is connected to the other end of straight pipes on the boom hanging on a pipe trolley 14. A connector trolley 15 provides fastening of the boom to a receiving terminal 17 and connecting LNG and vapour lines on the boom and on the vessel via chiksan swivels 16. The chiksan swivels prevent forces and bending moments being transferred to the pipes. The connector trolley reciprocates back and forth along the boom structure due to relative longitudinal movement between the platform and the vessel. All relative roll angles between the platform and the vessel (torsional loads) are taken by the flexible construction of the boom.

The connector trolley during offloading operation is attached to the receiving terminal by hinge joints 18 with cone 19 which together can be considered as a universal joint. The hinge joints provide rotating of the boom in vertical plane and compensate pitch angles between the platform and the vessel. The centre of rotation of the hinge joints is in the same axis as centre of rotation of the chiksan swivels 20. The cone 19 with landing skirt 24 is landed on the rotating table 21. The rotating table has series of roller bearings 22 to provide rotation in horizontal plane without transferring loads or/and moments to the table structure. The rotating table turns in horizontal plane relative to axis passing through centre of the rotating table when relative heading between the platform and the vessel is changed. For connecting and disconnecting of the offloading arm to/from the receiving terminal, pulling wire 23 and pulling winch installed on the vessel's deck (not shown) with self-tensioning device may be used. The pulling wire and the pulling winch may stay in tension during entire offloading operation.

Figure 6:
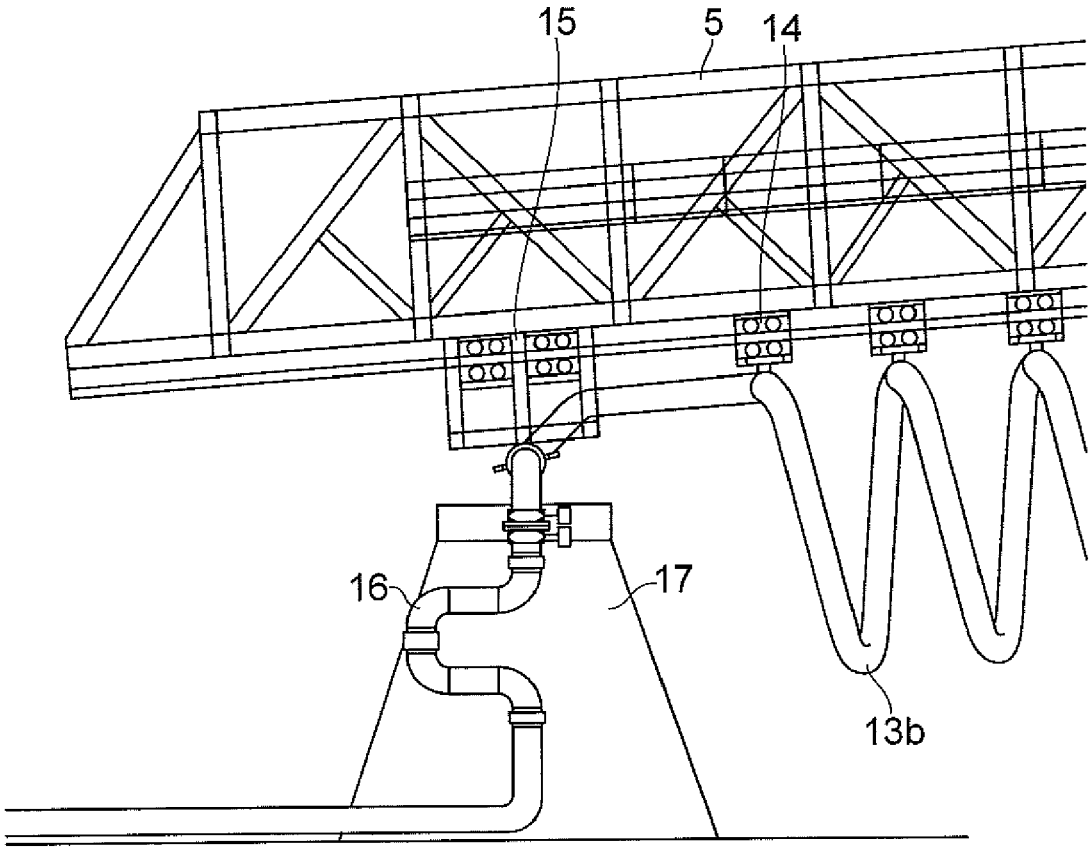
FIG. 6 shows side view of a second embodiment of the bridge type offloading boom, receiving terminal and pipe connectors installed on the vessel's forecastle deck.
Figure 7:
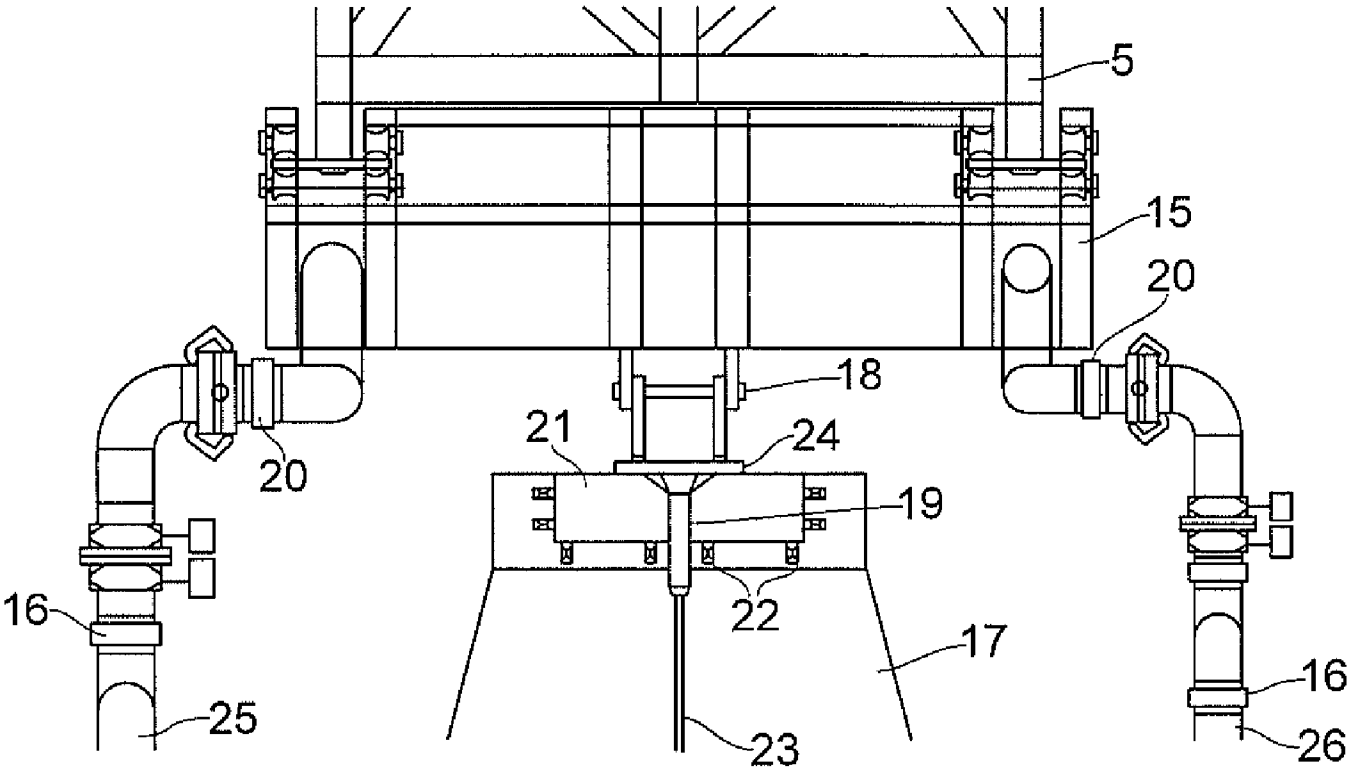
FIG. 7 shows a second embodiment of the connection between connector trolley and receiving terminal installed on the vessel's forecastle deck.

In another embodiment of the invention as shown in FIG. 5-7, relatively rigid spiral pipes 13*b* hanging from trolleys 14 on the boom structure compensate relative distance and relative heeling angle between the platform and the vessel. The spiral pipelines are so rigid that it is capable of sustaining a spiral structure under the combined weight of the pipeline and fluid within the pipeline when being suspended on or from the arm 5. The length of the spiral pipes shall be sufficient to compensate relative longitudinal motion between the platform and the vessel, and the rest of the pipe length on the boom could be straight pipe to reduce the weight. The pipe trolleys provide reciprocating movement of the spiral pipes along the boom structures. Connector trolley 15 provides fastening of the boom to the receiving terminal 17 and connecting LNG and vapour lines on the boom and on the vessel via chiksan swivels 16. The chiksan swivels prevent forces and bending moments being transferred to the pipes. The connector trolley reciprocates back and forth along the boom structure due to relative longitudinal movement between the platform and the vessel. All relative roll angles between the platform and the vessel (torsional loads) are taken by the flexible construction of the boom.

The connector trolley during offloading operation is attached to the receiving terminal by hinge joints 18 with pin 19 which together can be considered as a universal joint. The hinge joints provide rotating of the boom in vertical plane and compensate pitch angles between the platform and the vessel. The centre of rotation of the hinge joints is in the same axis as centre of rotation of the chiksan swivels 20. The pin 19 with landing skirt 24 is landed on the rotating table 21. The rotating table has series of roller bearings 22 to provide rotation in horizontal plane without transferring loads or/and moments to the table structure. The rotating table turns in horizontal plane relative to axis passing through centre of the rotating table when relative heading between the platform and the vessel is changed. For connecting and disconnecting of the offloading arm to/from the receiving terminal, pulling wire 23 and pulling winch installed on the vessel's deck (not shown) with self-tensioning device may be used. The pulling wire and the pulling winch may stay in tension during entire offloading operation.

The invention has now been explained in relation to two embodiments, but various elements may be changes and altered within the scope of the invention as defined in the following claims.

The invention claimed is:

1. A system for transferring a fluid between a first structure and a second structure which are movable relative to each other, comprising:

a. a crane pedestal adapted for mounting on the first structure, b. an offloading arm in the form of a single-boom crane boom rotatable about the crane pedestal in the horizontal plane and further moveable in the vertical plane, c. a connector trolley attached to the crane boom, said connector trolley being movable along the length of the crane boom, said connector trolley comprising a connection member having a universal joint adapted for fastening of said connector trolley to a receiving terminal on the second structure, d. a fluid-conveying pipe extending from the first structure along the crane boom and connected to the connector trolley, said fluid-conveying pipe having an arrangement for compensating for the longitudinal movement of the connector trolley, wherein said arrangement for compensating for the longitudinal movement of the connector trolley comprises a section of substantially rigid pipe being arranged along the crane boom in a spiral, the axis of said spiral pipe section being arranged parallel to the longitudinal axis of the crane boom.

2. A fluid transfer system according to claim 1 wherein the pipe is made of a material of sufficient rigidity that the spiral pipe section will maintain its spiral shape and parallel relationship with the crane boom under the combined weight of the spiral pipe section itself and its fluid contents, the longitudinal compensation being effected by compression and extension of the spiral pipe section.

3. A fluid transfer system according to claim 2 wherein the length of the spiral section is predetermined to permit an expected degree of longitudinal movement.

* * * * *